US009091476B2

(12) United States Patent
Kim et al.

(10) Patent No.: US 9,091,476 B2
(45) Date of Patent: Jul. 28, 2015

(54) REFRIGERATOR AND METHOD OF MANUFACTURING INNER DOOR THEREOF

(71) Applicant: SAMSUNG ELECTRONICS CO., LTD., Suwon-si, Gyeonggi-do (KR)

(72) Inventors: Byoung Mok Kim, Gwangju (KR); hyo Sik Kang, Gwangju (KR); Hyun Sang Yoo, Gwangju (KR); Young Jae Song, Gwangju (KR); Seung Yong Yang, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/072,291

(22) Filed: Nov. 5, 2013

(65) Prior Publication Data

US 2014/0132146 A1 May 15, 2014

(30) Foreign Application Priority Data

Nov. 9, 2012 (KR) ..... 10-2012-0126894

(51) Int. Cl.
*F25D 23/04* (2006.01)
*F25D 23/02* (2006.01)

(52) U.S. Cl.
CPC ..... *F25D 23/025* (2013.01); *F25D 23/02* (2013.01); *F25D 2323/021* (2013.01)

(58) Field of Classification Search
CPC ..... F25D 23/02; F25D 23/025; F25D 23/04
USPC ..... 312/321.5, 405.1, 405, 326, 329, 291, 312/292; 52/455–457, 800.1, 52/80.11–800.13, 800.15–800.18, 52/800.11–800.13; 62/448, 449
See application file for complete search history.

(56) References Cited

U.S. PATENT DOCUMENTS

| | | | | | |
|---|---|---|---|---|---|
| 1,927,398 | A | * | 9/1933 | Glasser | 62/377 |
| 2,046,909 | A | * | 7/1936 | Terry et al. | 312/300 |
| 2,129,923 | A | * | 9/1938 | Frankel | 312/236 |
| 2,131,680 | A | * | 9/1938 | Zahodiakin | 62/266 |
| 2,135,878 | A | * | 11/1938 | Sekyra, Sr. | 62/252 |
| 2,150,064 | A | * | 3/1939 | John et al. | 62/266 |
| 2,694,476 | A | * | 11/1954 | Hanssen | 52/800.18 |
| 2,942,438 | A | * | 6/1960 | Schmeling | 62/377 |
| 3,086,830 | A | * | 4/1963 | Malia | 312/200 |
| 4,013,371 | A | * | 3/1977 | Nagase | 403/187 |
| 2012/0062093 | A1 | * | 3/2012 | Lee et al. | 312/405 |
| 2014/0132142 | A1 | * | 5/2014 | Kim et al. | 312/405 |
| 2014/0132143 | A1 | * | 5/2014 | Kim et al. | 312/405 |
| 2014/0132144 | A1 | * | 5/2014 | Kim et al. | 312/405 |
| 2014/0139091 | A1 | * | 5/2014 | Oh et al. | 312/404 |

FOREIGN PATENT DOCUMENTS

KR 10-2005-0095235 9/2005

* cited by examiner

*Primary Examiner* — Janet M Wilkens
(74) *Attorney, Agent, or Firm* — Staas & Halsey LLP

(57) ABSTRACT

A refrigerator including a storage compartment, an inner door having an opening in a size corresponding to the storage compartment, a plurality of door guards provided at the opening, and an outer door to open/close the opening, the refrigerator further including a plurality of reinforcing members to prevent the inner door having the opening from being distorted.

18 Claims, 15 Drawing Sheets

REFRIGERATOR AND METHOD OF MANUFACTURING INNER DOOR THEREOF

CROSS-REFERENCE TO RELATED APPLICATIONS

This application claims the benefit of Korean Patent Application No. 10-2012-0126894, filed on Nov. 9, 2012, in the Korean Intellectual Property Office, the disclosure of which is incorporated herein by reference.

BACKGROUND

1. Field

Embodiments of the present disclosure relate to a refrigerator provided with an inner door having an opening, a door guard provided at the opening and an outer door to open and close the opening.

2. Description of the Related Art

In general, a refrigerator is a household appliance having a storage compartment to store foods, and a cool air supplying apparatus to supply cool air to the storage compartment to keep the foods in a fresh state for a long period of time.

The storage compartment is provided with a rack on which food are placed. The storage compartment has a front surface thereof open such that food is put in or taken out of, and the open front surface of the storage compartment is open and closed by a main door that is rotatably coupled to a body of the refrigerator. A door guard is provided at a rear surface of the main door to store food in addition to the rack disposed in the storage compartment.

Since the door guard is provided at the rear surface of the main door, an access to the door guard is achieved by opening the main door. Meanwhile, another type of refrigerator is provided with a subsidiary door formed on a main door to enable access to a door guard without opening the main door. Such a refrigerator having a subsidiary door enables access to a door guard provided at a rear surface of the door by only opening the subsidiary door without opening the door, so that the food keeping is diversified and cool air is retained.

However, since the subsidiary door has a size limitation, access is made only to some of a plurality of door guards that are provided at the rear surface of the main door one above the other.

SUMMARY

Therefore, it is an aspect of the present disclosure to provide a refrigerator ensuring an access to all of a plurality of door guards provided at a main door by opening only a subsidiary door without opening the main door, and a manufacturing method thereof.

Additional aspects of the disclosure will be set forth in part in the description which follows and, in part, will be apparent from the description, or may be learned by practice of the disclosure.

In accordance with one aspect of the present disclosure, a refrigerator includes a body, a storage compartment, an inner door, a plurality of door guards, an outer door, at least one first reinforcing member and a second reinforcing member. The storage compartment may be formed at an inside of the body. The inner door may include an opening corresponding to the storage compartment, an inner panel having an upper side frame, a lower side frame, a left side frame and a right side frame, and an outer panel coupled to the inner panel, the inner door rotatably coupled to the body. The plurality of door guards may be provided at the opening. The outer door may be rotatably coupled to the body to open and close the opening. The at least one first reinforcing member may be configured to connect the left side frame to the right side frame while traversing the opening. The second reinforcing member may be provided at the upper side frame, the lower side frame, the left side frame and the right side frame.

The inner panel may include one pair of inside walls that support the door guard while forming the opening. The first reinforcing member may be fastened to the inside wall through a fastening member.

The inside wall may be formed to be flat from an entry of the opening to an exit of the opening, and a distance between the one pair of inside walls from the entry of the opening to the exit of the opening may be constant.

The first reinforcing member may include a connection part traversing the opening, and one pair of coupling parts coming into close contact with the one pair of inside walls by being bent from both ends of the connection part.

The refrigerator may further include an attachment panel that is provided at an opposite side of the first reinforcing member with respect to the inside wall to increase a fastening force of the fastening member such that the attachment panel is fastened to the first reinforcing member and the inside wall.

The fastening member may be a screw.

The second reinforcing member may be provided at an inner space formed by the inner panel and the outer panel.

The inner panel may be provided with an accommodation space to accommodate the second reinforcing member and with a hook part to fix the second reinforcing member.

The second reinforcing member may be integrally formed of an upper side reinforcing part, a lower side reinforcing part, a left side reinforcing part and a right side reinforcing part in a shape of a rectangular frame.

The second reinforcing member may be fixed to the inner panel before a blowing agent is foamed between the inner panel and the outer panel.

In accordance with another aspect of the present disclosure, a refrigerator includes a body, a storage compartment, an inner door, a plurality of door guards, an outer door, and at least one reinforcing member. The storage compartment may be formed at an inside of the body. The inner door may include an opening corresponding to the storage compartment, an inner panel having an upper side frame, a lower side frame, a left side frame and a right side frame, and an outer panel coupled to the inner panel, the inner door being rotatably coupled to the body. The plurality of door guards may be provided at the opening. The outer door may be rotatably coupled to the body to open and close the opening. The at least one reinforcing member may be configured to connect the left side frame to the right side frame while traversing the opening to prevent the inner door from being distorted.

The refrigerator may further include a fastening member configured to fasten the reinforcing member to the left side frame and the right side frame.

The refrigerator may further include attachment panels that are provided at the left side frame and the right side frame to increase a fastening force of the fastening member.

In accordance with another aspect of the present disclosure, a refrigerator includes a body, a storage compartment, an inner door, a plurality of door guards, an outer door, and a reinforcing member. The storage compartment may be formed at an inside of the body. The inner door may include an opening corresponding to the storage compartment, an inner panel having an upper side frame, a lower side frame, a left side frame and a right side frame, and an outer panel coupled to the inner panel, the inner door rotatably coupled to the body. The plurality of door guards may be provided at the opening. The outer door may be rotatably coupled to the body to open and close the opening. The reinforcing member may be provided at the upper side frame, the lower side frame, the left side frame and the right side frame to prevent the inner door from being distorted.

The reinforcing member may be integrally formed of an upper side reinforcing part, a lower side reinforcing part, a left side reinforcing part and a right side reinforcing part.

The inner panel may be provided with an accommodation space to accommodate the reinforcing member and with a hook part to fix the reinforcing member.

As is apparent from the above description, an inner door having an opening is prevented from being distorted.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
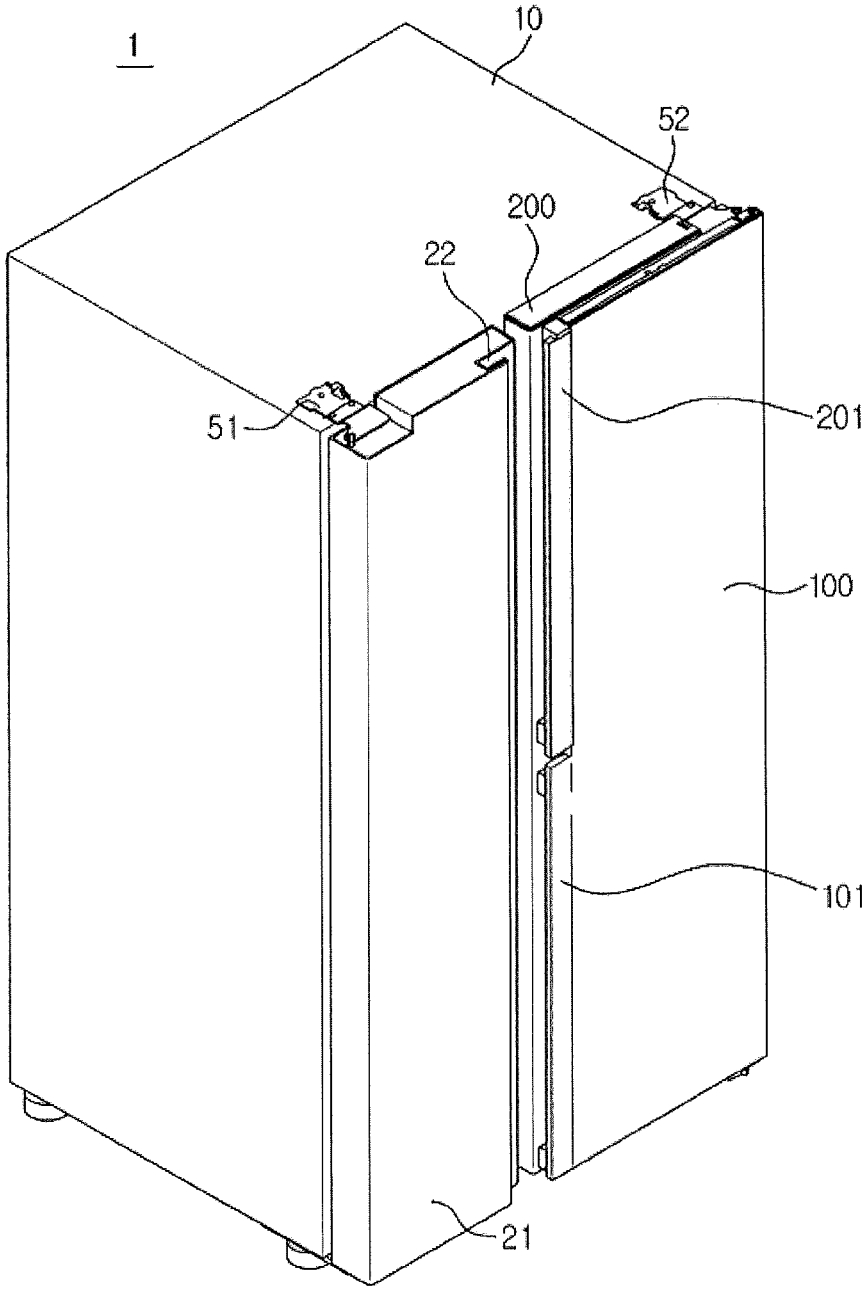
FIG. 1 is a drawing illustrating a refrigerator in accordance with an embodiment of the present disclosure, in a state of an inner door and an outer door being closed.

Reference will now be made in detail to the embodiments of the present disclosure, examples of which are illustrated in the accompanying drawings, wherein like reference numerals refer to like elements throughout.

Figure 2:
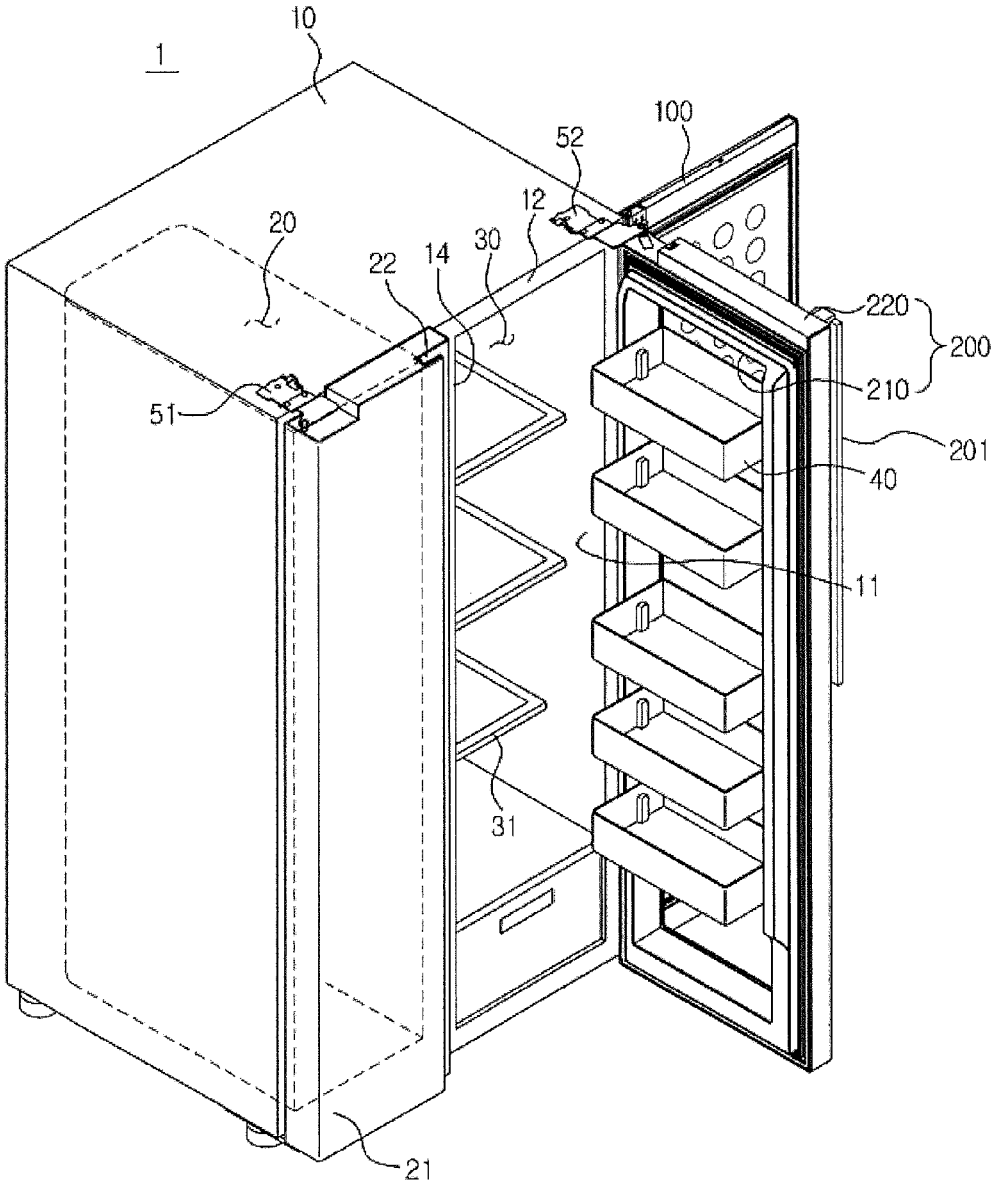
FIG. 2 is a drawing illustrating the refrigerator of FIG. 1, in a state of the inner door and the outer door being separately open.
Figure 3:
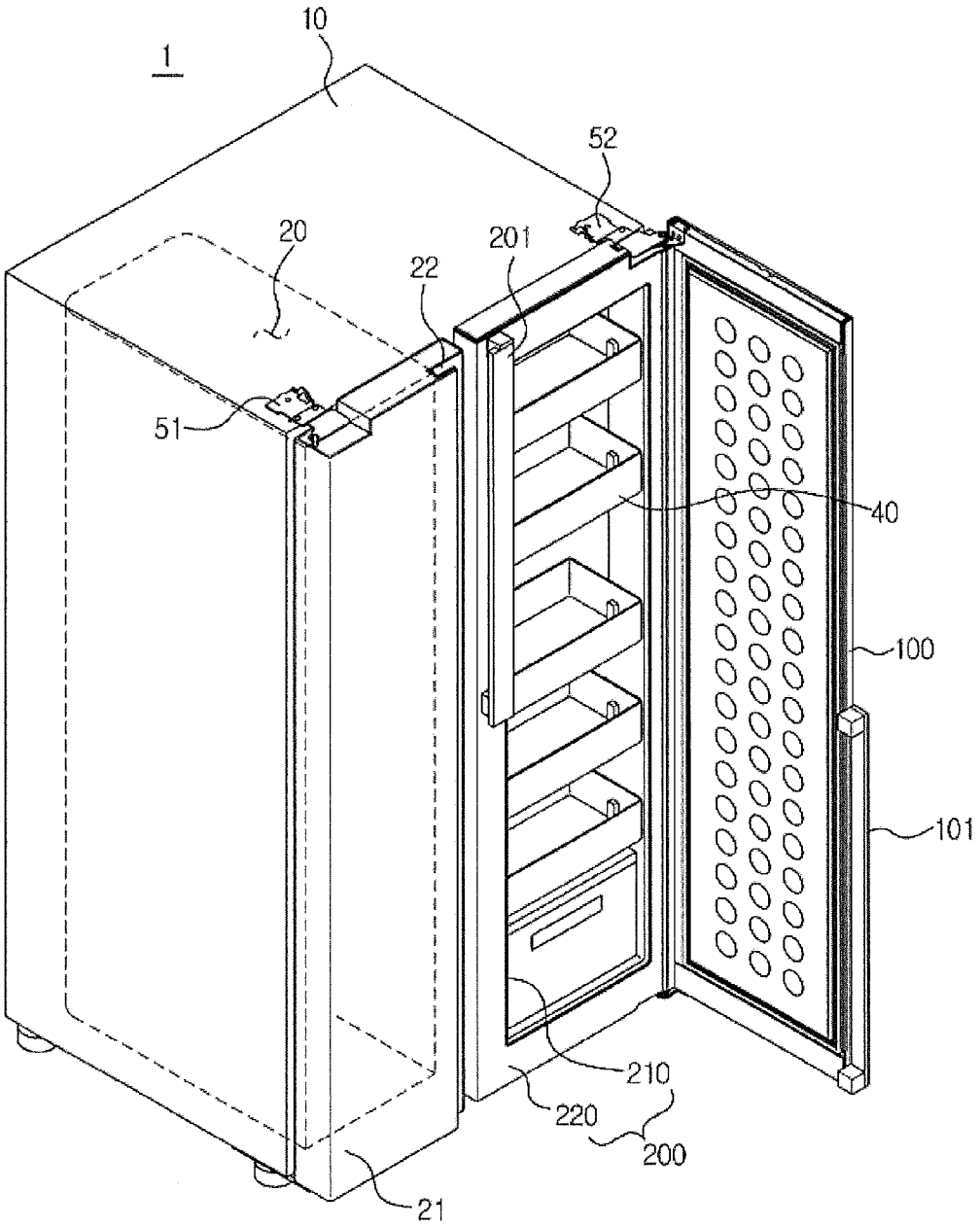
FIG. 3 is a drawing illustrating the refrigerator of FIG. 1, in a state of only the inner door being open.
Figure 4:
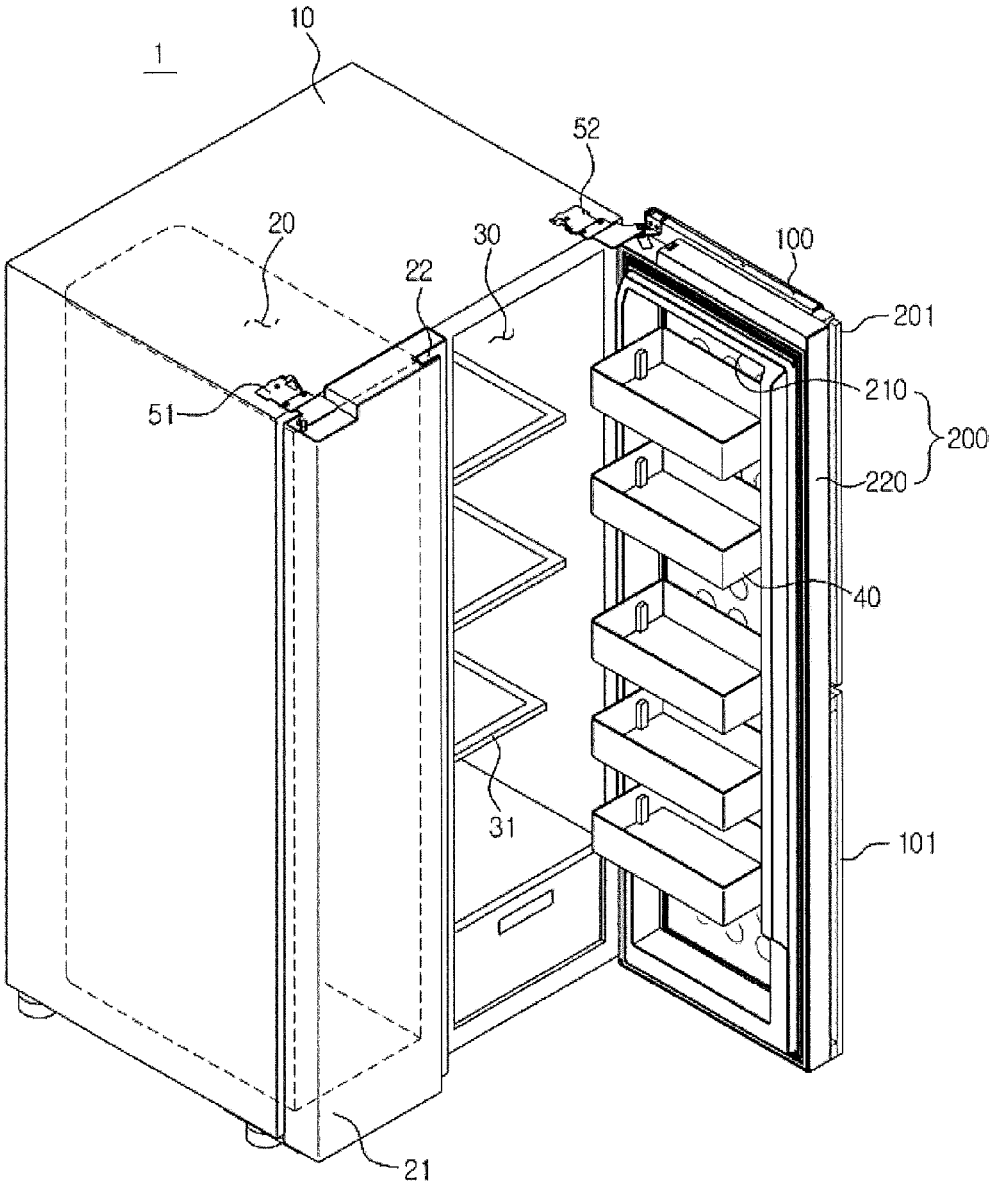
FIG. 4 is a drawing illustrating the refrigerator of FIG. 1, in a state of the outer door being open.

FIG. 1 is a drawing illustrating a refrigerator in accordance with an embodiment of the present disclosure, in a state of an inner door and an outer door being closed, FIG. 2 is a drawing illustrating the refrigerator of FIG. 1, in a state of the inner door and the outer door being separately open, FIG. 3 is a drawing illustrating the refrigerator of FIG. 1, in a state of only the inner door being open, and FIG. 4 is a drawing illustrating the refrigerator of FIG. 1, in a state of only the outer door being open.

Referring to FIGS. 1 to 4, a refrigerator 1 in accordance with an embodiment of the present discourse includes a body 10, storage compartments 20 and 30 provided at an inside the body 10, and a cool air supply apparatus to supply cool air to the storage compartments 20 and 30.

The body 10 is provided in an approximate body shape, and includes a inner case 11 forming the storage compartments 20 and 30, an outer case 12 forming the external appearance of the refrigerator 1 while being coupled to an outside of the inner case 11, and a heat insulation material provided between the inner case 11 and the outer case 12. The inner case 11 may be formed of resin, and the outer case 12 may be formed of metal.

The cool air supply apparatus includes a compressor (not shown), a condenser (not shown), an expansion valve (not shown) and an evaporator (not shown) to circulate refrigerant and generate cool air by use of latent heat of evaporation.

The storage compartments 20 and 30 are divided by a middle wall 14 into a freezing compartment 20 on the left side and a refrigerating compartment 30 on the right. However, the position of the freezing compartment 20 and the refrigerating compartment 30 may be interchangeable. The refrigerating compartment 30 is provided with a rack 31 on which foods are placed.

The freezing compartment 20 and the refrigerating compartment 30 have open front surfaces thereof allowing food to be put in or taken out, and the open front surface of the freezing compartment 20 is closed by a freezing compartment door 21, and the open front surface of the refrigerating compartment 30 is closed by an outer door 100 and an inner door 200.

The freezing compartment door 21 is rotatably coupled to the body 10 by an upper side hinge member 51 and a lower side hinge member (not shown). The outer door 100 and the inner door 220 are rotatably coupled to the body 10 by an upper side hinge member 52 and a lower side hinge member (not shown).

Although not shown in detail, the outer door 100 and the inner door 200 may have different rotating shafts, or may share a single rotating shaft.

The freezing compartment door 21, the outer door 100 and the inner door 200 may have a handle 22, a handle 101 and a handle 201, respectively.

Meanwhile, the inner door 200 includes an opening 210 having a size substantially corresponding to that of the refrigerating compartment 30, and a door frame 220 forming the opening 210. Accordingly, the door frame 220 is provided in a shape of a rectangular frame.

A plurality of door guards 40 are provided at the opening 210 to accommodate foods. The door guards 40 may store foods having a low height and small size or foods that are frequently put in and taken out. The plurality of door guards 40 are aligned at the opening 210 one above the other.

The outer door 100 is provided in the shape of an approximate flat panel having no opening. Accordingly, the outer door 100 is configured to open and close the opening 210 of the inner door 20.

As for the operational use of the inner door 200 and the outer door 100 in accordance with the embodiment of the present disclosure having the configuration as the above, as shown in FIG. 1, if the inner door 200 and the outer door 10 are closed, the refrigerating compartment 30 is sealed and cool air is kept in the refrigerating compartment 30.

Referring to FIG. 3, when the outer door 1 is open, a user accesses the plurality of door guards 40 to put in or take out foods at the plurality of door guards 40. At this time, the cool air leakage of the refrigerating compartment 30 is restricted when compared to a state of the inner door 200 being open.

Referring to FIG. 4, when the inner door 200 is open, the user accesses the inside of the refrigerating compartment 30 to put in or take out foods stored in the rack 31. At this time, the user may access the plurality of door guards 40 as well, to put in or take out foods at the plurality of door guards 40.

As described above, the refrigerator 1 in accordance with the embodiment of the present disclosure enables foods to be put in and taken out in various methods according to user's demand, and also minimizing cool air from leaking since only the outer door 100 is open when the foods stored in the plurality of door guards 40 are put in or taken out.

Further, the refrigerator 1 in accordance with the embodiment of the present disclosure has an enlarged storage space when compared to a conventional refrigerator, thereby enhancing the diversity of food keeping while prevention cool air leakage.

Hereinafter, the inner door 200, the outer door 100 and the door guard 40 of the refrigerator 1 in accordance with the embodiment of the present disclosure will be described in detail.

Figure 5:
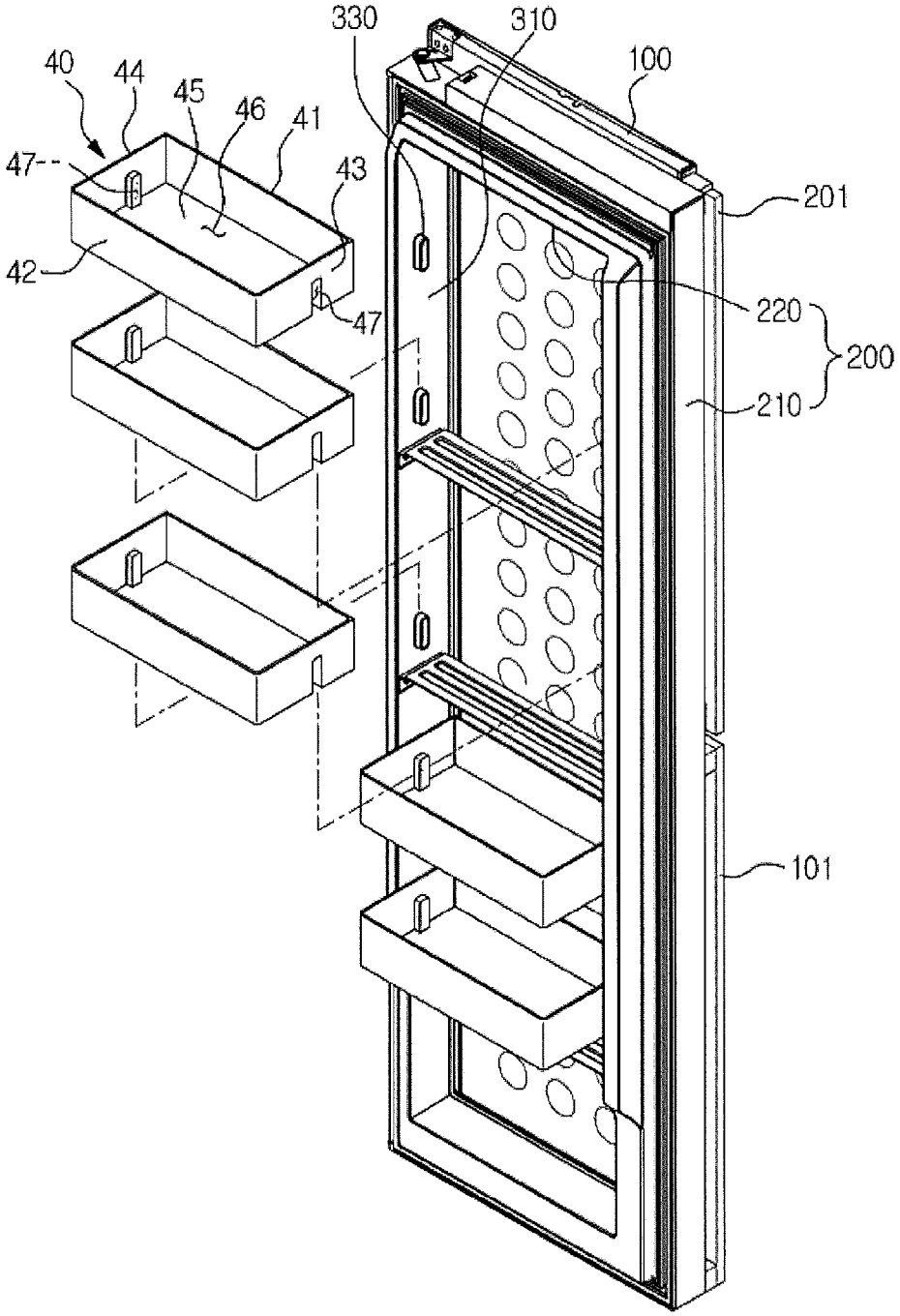
FIG. 5 is a drawing illustrating the inner door and door guards of the refrigerator of FIG. 1.
Figure 6:
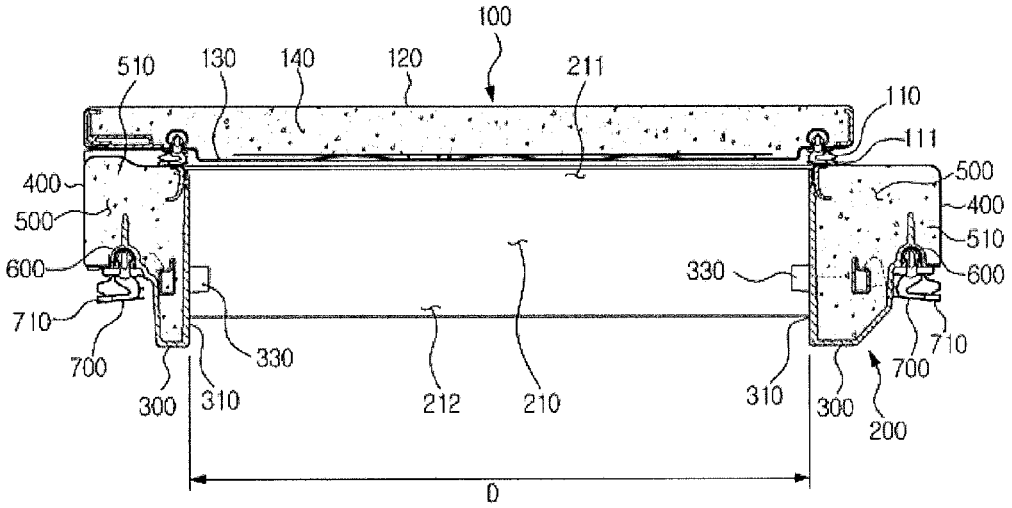
FIG. 6 is a cross sectional view illustrating the inner door and the outer door of the refrigerator of FIG. 1.
Figure 7:
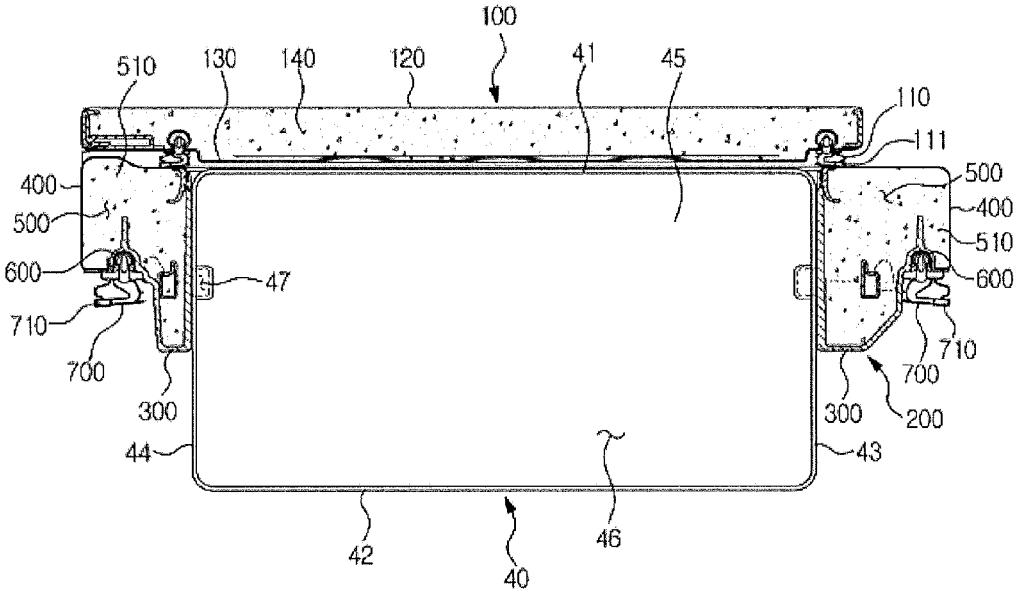
FIG. 7 is a cross sectional view illustrating a state of the door guard being installed on the inner door of the refrigerator of FIG. 1.
Figure 8:
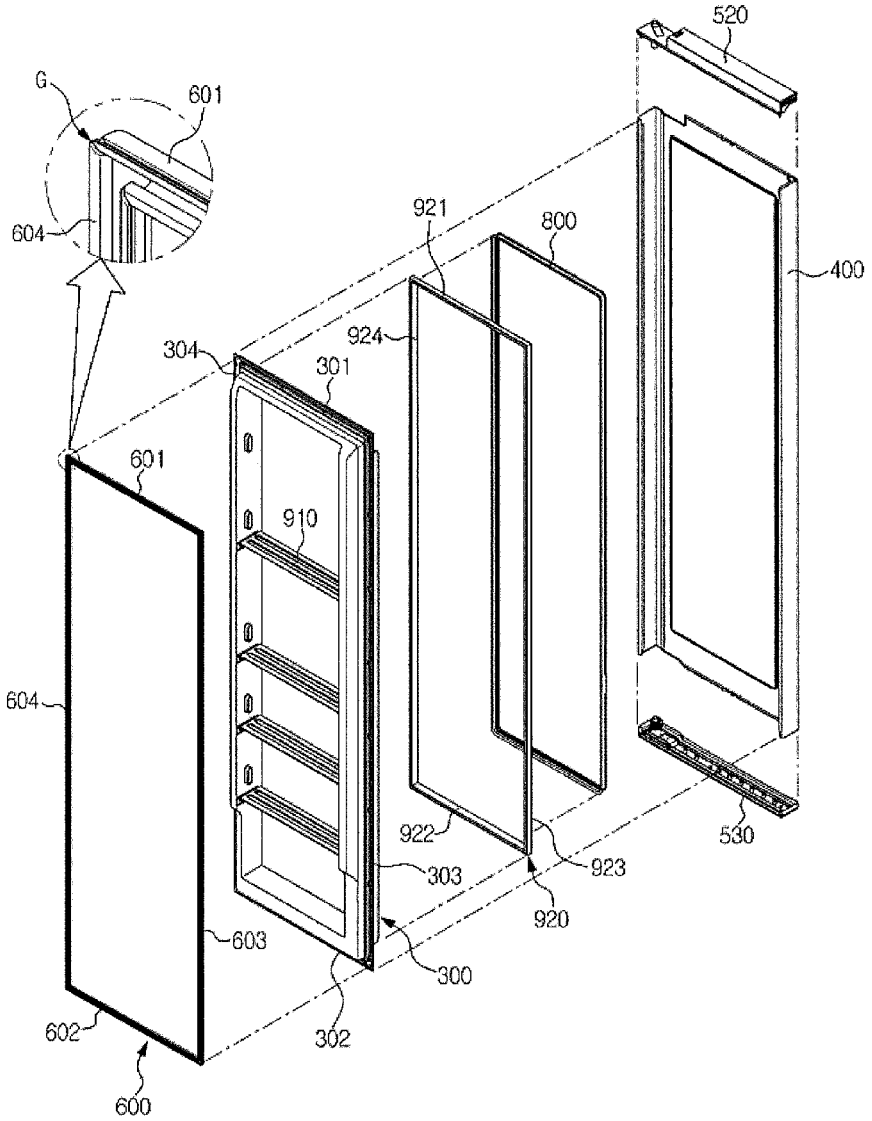
FIG. 8 is an exploded perspective view illustrating the construction of the inner door of the refrigerator of FIG. 1.
Figure 9:
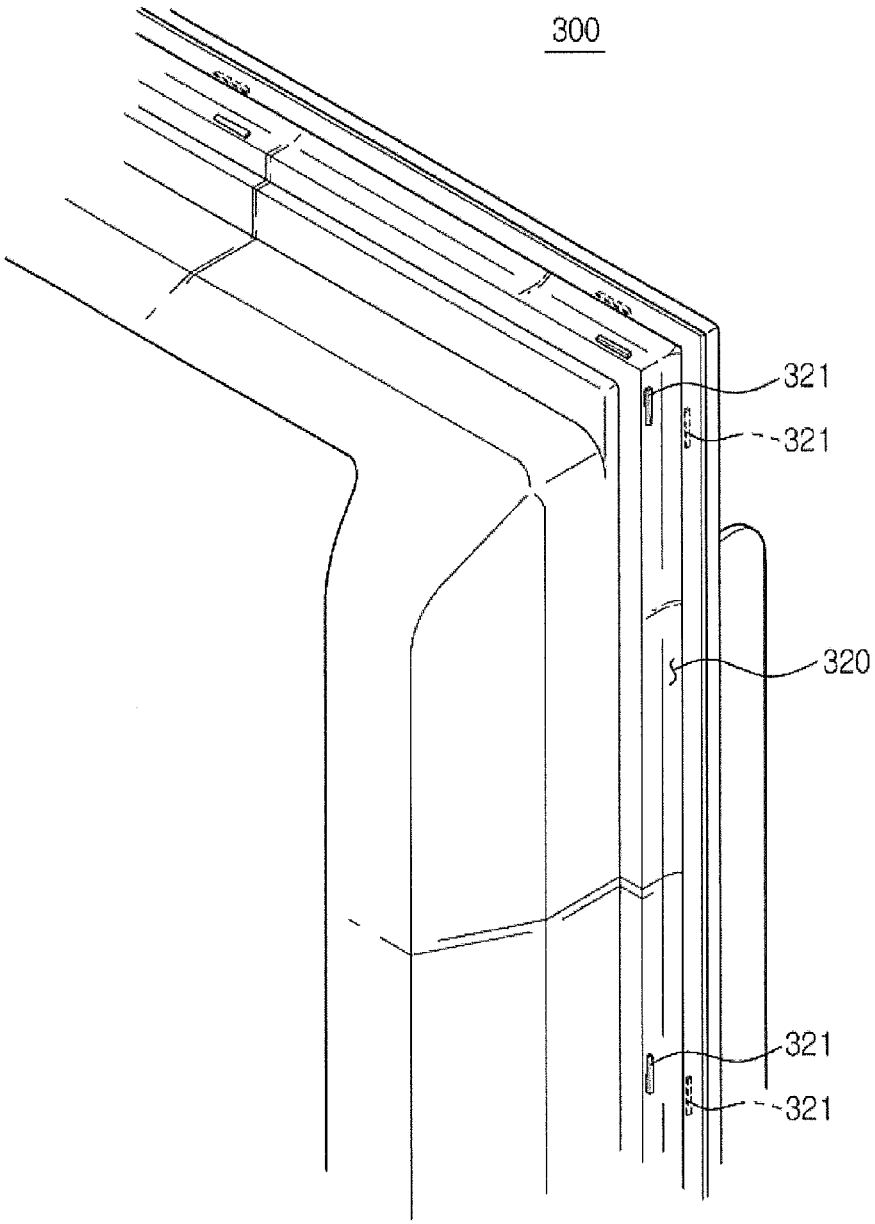
FIG. 9 is a drawing illustrating a portion of an inner panel of the inner door of the refrigerator of FIG. 1.
Figure 10:
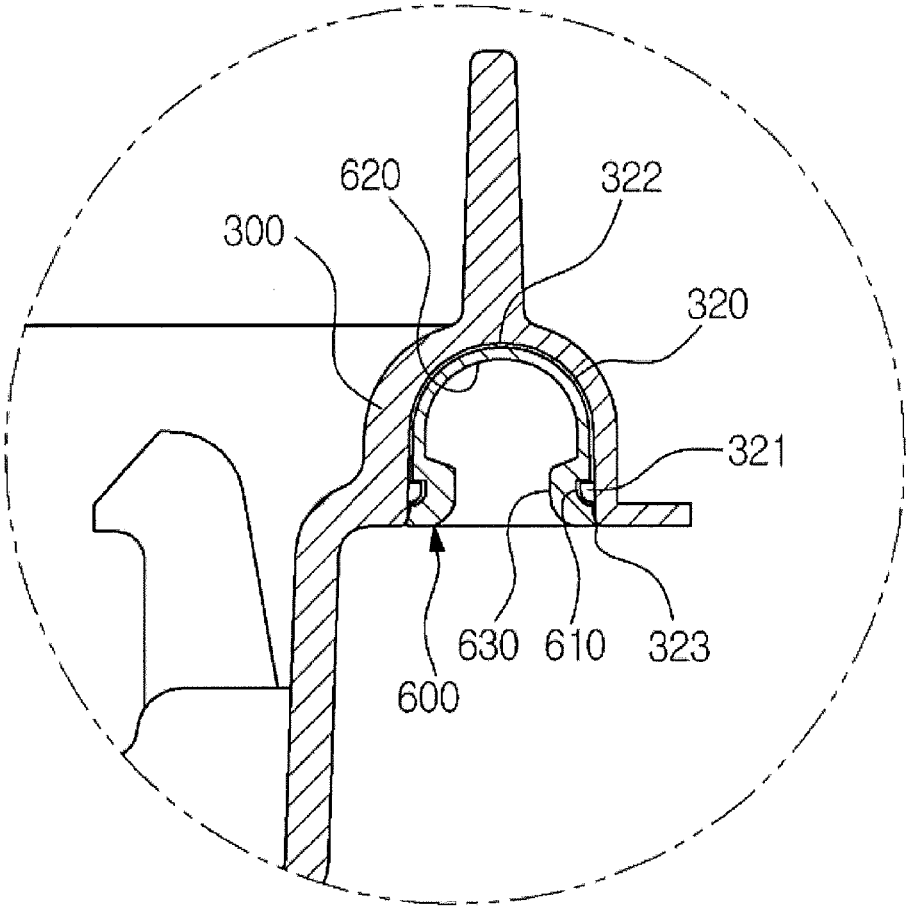
FIG. 10 is a cross sectional view illustrating a state of an installation member accommodated in the inner panel of the inner door of the refrigerator of FIG. 1.
Figure 11:
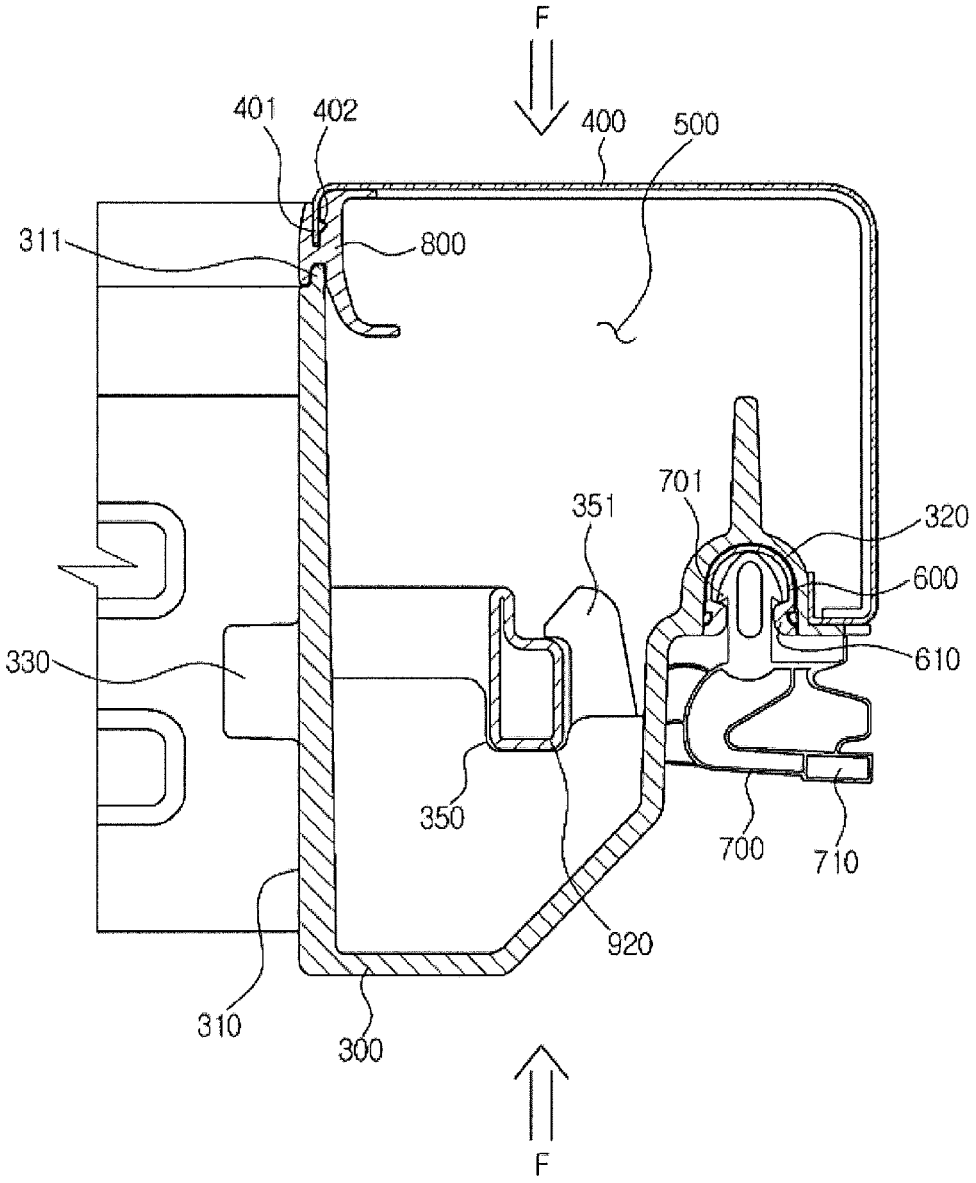
FIG. 11 is a cross sectional view illustrating a portion of the inner door of the refrigerator of FIG. 1.
Figure 12:
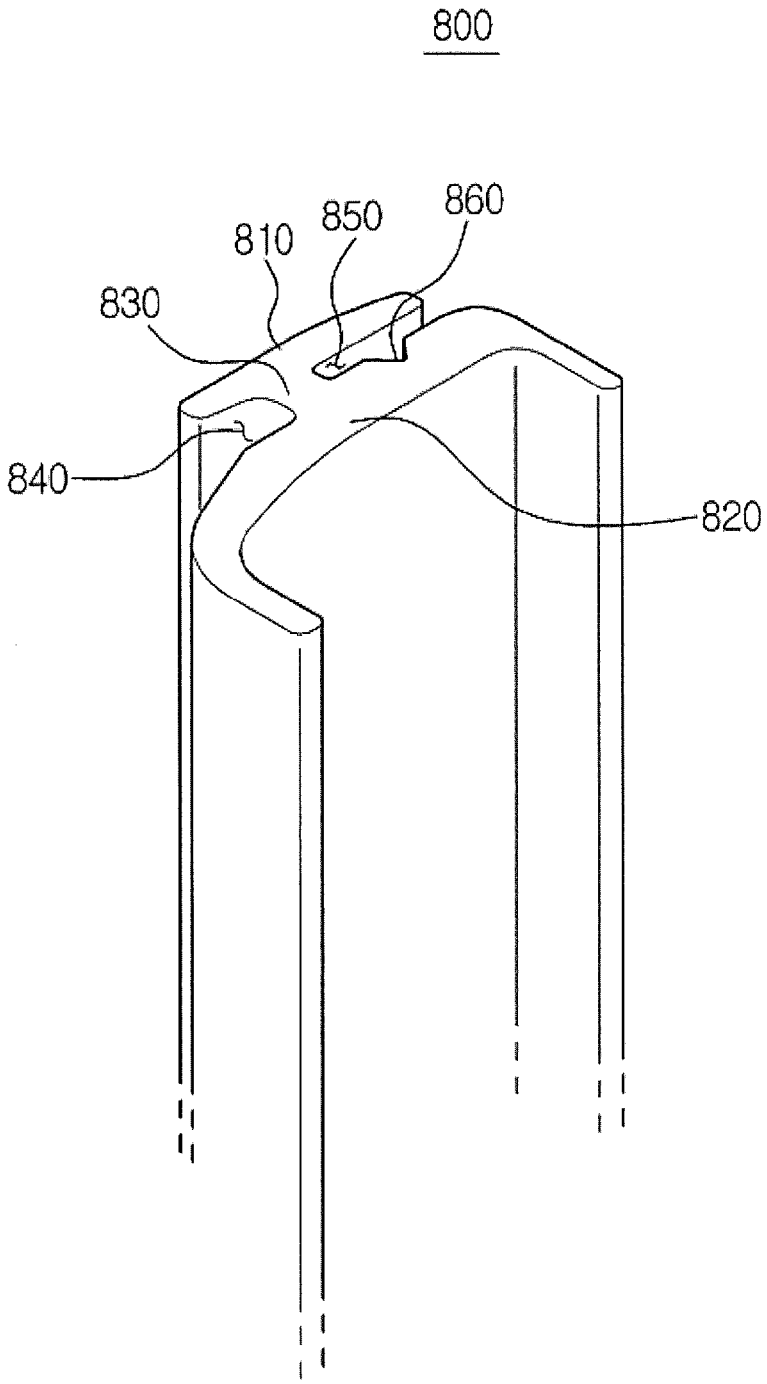
FIG. 12 is a drawing illustrating a door trim of the refrigerator of FIG. 1.

FIG. 5 is a drawing illustrating the inner door and a door guard of the refrigerator of FIG. 1, FIG. 6 is a cross sectional view illustrating the inner door and the outer door of the refrigerator of FIG. 1, FIG. 7 is a cross sectional view illustrating a state of the door guard being installed on the inner door of the refrigerator of FIG. 1, FIG. 8 is an exploded perspective view illustrating construction of the inner door of the refrigerator of FIG. 1, FIG. 9 is a drawing illustrating a portion of an inner panel of the inner door of the refrigerator of FIG. 1, FIG. 10 is a cross sectional view illustrating a state of an installation member accommodated in the inner panel of the inner door of the refrigerator of FIG. 1, FIG. 11 is a cross sectional view illustrating a portion of the inner door of the refrigerator of FIG. 1, and FIG. 12 is a drawing illustrating a door trim of the refrigerator of FIG. 1.

Referring to FIG. 5, the door guard 40 is provided in an approximate box shape. Accordingly, the door guard 40 has a front side wall 41, a rear side wall 42, a left side wall 43, a right side wall 44, a bottom side wall 45 and a storage space 46 to store foods. The left side wall 43 and the right side wall 44 of the door guard 40 may be provided with support grooves 47, respectively.

The inner door 200 includes inside walls 310 provided at both sides of the opening 210 to support the door guard 40, and the inside wall 310 is provided with a support protrusion 330 inserted into the support grooves 47 of the door guard 40.

As the support protrusion 330 is inserted into the support groove 47, the door guard 40 is mounted on the opening 210. The door guard 40 may be separated from the opening 21, and although not shown, the door guard 40 may be provided so as to be slidable in a front and rear side direction or a upper and lower side direction.

Referring to FIG. 8, the inner door 200 includes an inner panel 300, an outer panel 400 coupled to the inner panel 300 and allowing a foaming space (500 in FIG. 6) to be formed between the inner panel 300 and the outer panel 400, a plurality of installation members 600 coupled to a rear surface of the inner panel 300 and allowing a gasket (700 in FIG. 6) to be installed thereon, a plurality of reinforcing members 910 and 920 to prevent the inner door 200 from being distorted, and a door trim 800 coupled to between an end portion of the inner panel 300 and an end portion of the outer panel 300 to prevent blowing agent foamed in the foaming space 500 from leaking to the outside.

The inner panel 300 includes an upper side frame 301, a lower side frame 302, a left side frame 303 and a right side frame 304, and may be formed of resin as an integrated part through injection molding. The outer panel 400 may be formed of metal.

Referring to FIG. 6, the inner panel 300 includes one pair of inside walls 310 provided at both sides of the opening 210. The inside wall 310 may support the door guards (40 in FIG. 7) while forming the opening 210.

In this case, the inside wall 310 is formed to be flat from an entry 211 of the opening 210 to an exit 212 of the opening 210 without having a curvature. In addition, a distance D between the one pair of inside walls 310 may be constant from the entry 211 of the opening 210 to the exit 212 of the opening 210.

Since the inside wall 310 is formed to be flat, the size of the opening 210 is maximized, and in order to flatten the inside wall 310, the inside wall 310 is formed through injection molding other than vacuum forming.

The vacuum forming is a manufacturing method in which air between a resin sheet and a mold is suctioned such that the sheet is molded in close contact with the mold. The vacuum forming is cost effective when compared to the injection molding and ensures easy manufacturing, but has a difficulty in forming a flat surface perpendicular to a mold since the sheet needs to come into close contact with the mold.

Referring to FIG. 7, the door guard 40 has the front side wall 41 disposed so as to make contact with the entry 211 of the opening 210 to form a portion of a front surface of the inner door 200, and the front side wall 41 of the door guard 40 is completely exposed without being blocked by the inner door 200.

Through such a configuration, the door guard 40 takes all area of the opening 210, and the size of the door guard 40 is maximized. In addition, when the door guard 40 is viewed from outside the inner door 200, the door guard 40 is completely exposed, so that the state of the food stored in the door guard 40 is easily checked.

The door guard 40 of the refrigerator in the embodiment of the present disclosure is provided at the opening 210 of the inner door 20 other than at a rear surface of the outer door 100.

The outer door 100 includes an outer door inner panel 130, an outer door outer panel 120, an insulating material 140 provided between an outer door inner panel 130 and the outer door outer panel 120, and a gasket 110.

The outer door inner panel 130 may be formed of resin through a vacuum forming, and the outer door outer panel 120 may be formed of metal. The gasket 110 includes a magnet 111, and the magnet 111 may interact with the outer panel 400 of the inner door 200, which is formed of metal.

Meanwhile, the plurality of installation members 600 are configured to enable the gasket 700 to be installed on the inner panel 300 while minimizing the use of a complicated mold, such as a slide core, during an injection molding, and the plurality of installation member 600 are coupled to a rim of a rear surface of the inner panel 300.

Referring to FIG. 8, the plurality of installation members 600 include a first installation member 601 coupled to the upper side frame 301 of the inner panel 300, a second installation member 602 coupled to the lower side frame 302 of the inner panel 300, a third installation member 603 coupled to the left side frame 303 of the inner panel 300, and a fourth installation member 604 coupled to the right side frame 304 of the inner panel 300.

In the description of the present disclosure, the first installation member 601, the second installation member 602, the third installation member 603 and the fourth installation member 604 may be referred to as the installation member 600 as a whole if there is no need to distinguish the respective installation members 601, 602, 603 and 604.

In this case, the first installation member 601, the second installation member 602, the third installation member 603 and the fourth installation member 604 are not connected to one other and spaced apart from one another by a predetermined gap G. Accordingly, the first installation member 601, the second installation member 602, the third installation member 603 and the fourth installation member 603 are prevented from being interfered with one another due to thermal expansion.

Referring to FIGS. 9 and 10, the inner panel 300 is provided at the rim of the rear surface thereof with an accommodation groove 320 to accommodate the installation member 600. The accommodation groove 320 has a cross sectional area increasing from a deepest position 322 thereof to a shallowest position 323 thereof. That is, the accommodation groove 320 may be formed through a general mold instead of a complicated mold, such as a slide core.

A plurality of accommodation protrusions 321 protrude toward the accommodation groove 320 to fix the installation member 600. The plurality of accommodation protrusions 321 are not formed over the entire area of the accommodation groove 320, but formed on some area of the accommodation groove 320. The plurality of accommodation protrusions 321 are formed while being spaced apart from one another.

The installation member 600 includes an installation groove 620 on which the gasket (700 in FIG. 11) is installed, an installation protrusion 630 protruding inward of the installation groove 620 to fix the gasket 700 including a magnet 710, and an insertion groove 610 into which the accommodation protrusion 321 of the inner panel 300 is inserted.

As the installation protrusion 630 is interfered with a fixing protrusion (701 in FIG. 11) of the gasket 700, the gasket 700 is fixed. The installation groove 620 and the installation protrusion 630 of the installation member 600 are integrally formed with each other through an extrusion molding.

According to the refrigerator 1 of the embodiment of the present disclosure, the installation member 600 is inserted into the accommodation groove 320 formed in the inner panel 300 of the inner door 200, and the gasket 700 is inserted into the installation groove 620 formed in the installation member 600, thereby installing the gasket 700 on the inner panel 300. In this process, the inner panel 300 is injection molded through a simple mold, and the installation member 600 is formed through an extrusion molding.

Meanwhile, the door trim 800 is provided to prevent blowing agent in the foaming space 500 between the inner panel 300 and the outer panel 400 from leaking to the outside, and referring to FIGS. 11 and 12, the door trim 800 includes a first insertion groove 840 with which an end portion 311 of the inside wall 310 of the inner panel 300 comes into close contact, and a second insertion groove 850 with which an end portion 401 of the outer panel 400 comes into close contact.

In addition, the door trim 800 includes a first support part 810 to support the inner panel 300 and the outer panel 400 from outside, a second support part 820 to support the inner panel 300 and the outer panel 400 from inside, and a connection part 830 connecting the first support part 810 to the second support part 820.

The second support part 820 may be provided with a coupling groove 860, into which a coupling protrusion 402 of the outer panel 400 is inserted, to increase the coupling strength of the door trim 800 and the outer panel 400.

A foaming process of the inner door 300 including the door trim 800 is as follows.

First, the inner panel 300, the outer panel 400 and the door trim 800 are preliminarily coupled to one other, and while having the inner panel 300 placed to face the bottom and the outer panel 400 placed to face the top, the inner panel 300 and the outer panel 400 are pressed in an upper side and lower side direction F by use of a fixing jig (not shown).

Thereafter, blowing agent is injected between the foaming space 500 formed between the inner panel 300 and the outer panel 400 to be foamed. At this time, since the inner panel 300 and the outer panel 400 are being pressed in the upper side and lower side direction, the inner panel 300 and the outer panel 400 are prevented from being separated from each other due to a foaming pressure in a upper side and lower side direction, thereby preventing a blowing agent from leaking in a upper side and lower side direction.

In addition, since the door trim 800 firmly holds the end portion 311 of the inner panel 300 and the end portion 402 of the outer panel 400, the inner panel 300 and the outer panel 400 are prevented from being separated from each other by a foaming pressure in a left side and right side direction, thereby preventing a blowing agent from leaking.

Without the door trim 800, even if portions of the inner panel 300 and the outer panel 400, which are adjacent to the opening, may be overlapped, the inner panel 300 and the outer panel 400 are separated from each other by a foaming pressure and thus blowing agent may leak.

As the foaming of the blowing agent in the foaming space 500 is completed, the inner panel 300, the outer panel 400 and the door trim 800 may be firmly coupled to one another by the adhesive force of the blowing agent.

Meanwhile, the inner door 200 of the refrigerator 1 in accordance with the aspect of the present disclosure, which has the opening 210, is vulnerable to distortion. In addition, the inner door 200 may be distorted due to the foaming pressure during the foaming process of the inner door 20, or may have a difficulty in forming the inside wall 310 to be flat. In order to resolve such a shortcoming, the plurality of reinforcing members (910 and 920 in FIG. 8) may be provided in the inner door 200.

The plurality of reinforcing members 910 and 920 include a first reinforcing member 910 connecting the left side frame 303 of the inner panel 300 to the right side frame 304 of the inner panel 300 while traversing the opening 210, and a second reinforcing member 920 provided at the upper side frame 301 of the inner panel 300, the lower side frame 302 of the inner panel 300, the left side frame 303 of the inner panel 300 and the right side frame 304 of the inner panel 300.

The first reinforcing member 910 is to be described later. As for the configuration of the second reinforcing member 920, the second reinforcing member 920 includes an upper side reinforcing part 921, a lower side reinforcing part 922, a left side reinforcing part 923 and a right side reinforcing part 924, and provided in a shape of an approximate rectangular frame. The second reinforcing member 920 is integrally formed of metal having rigidity.

Referring to FIG. 11, the inner panel 300 is provided with an accommodation space 350 to accommodate the second reinforcing member 920, and a hook part 351 to fix the second reinforcing member 920. Accordingly, the second reinforcing member 920 is coupled to the inner panel 300, and disposed between the inner panel 300 and the outer panel 400. Accordingly, the second reinforcing member 920 is not exposed to the outside.

The second reinforcing member 920 is fixed to the inner panel 300 before the blowing agent is foamed in the foaming space 500 between the inner panel 300 and the outer panel 400.

Figure 13:
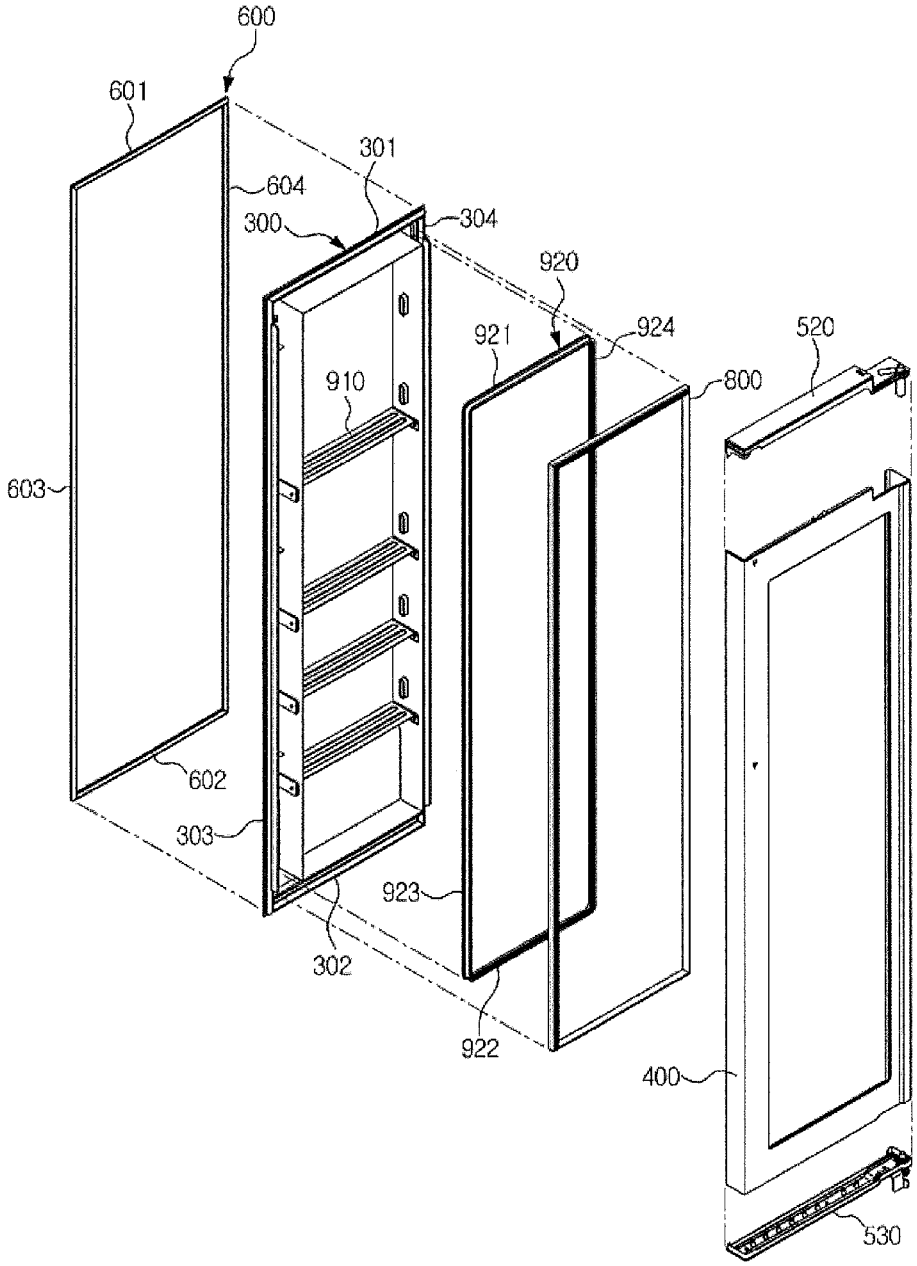
FIG. 13 is an exploded perspective view illustrating the construction of the inner door of the refrigerator of FIG. 1 shown at a different angle.
Figure 14:
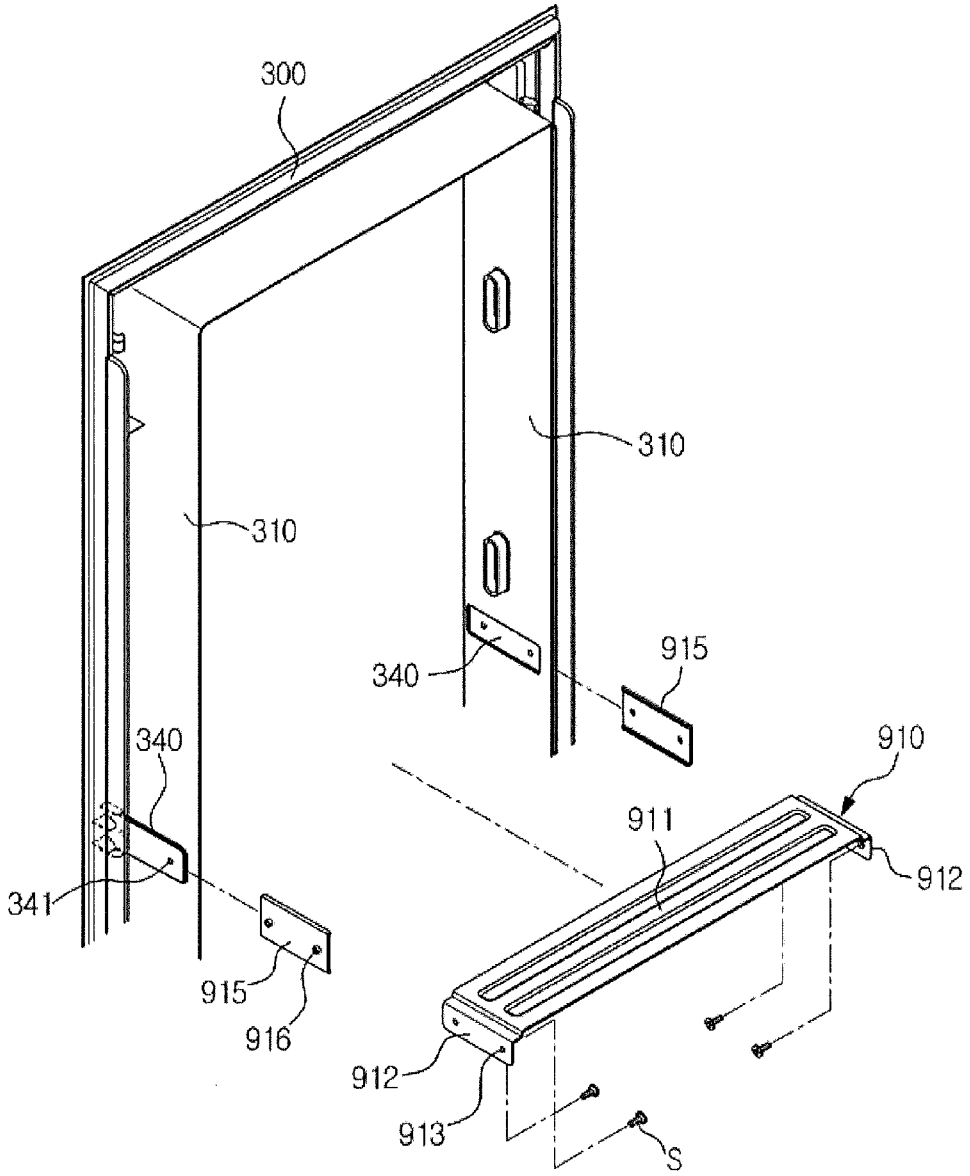
FIG. 14 is an exploded perspective view illustrating a coupling structure of a first reinforcing member of the refrigerator of FIG. 1.
Figure 15:
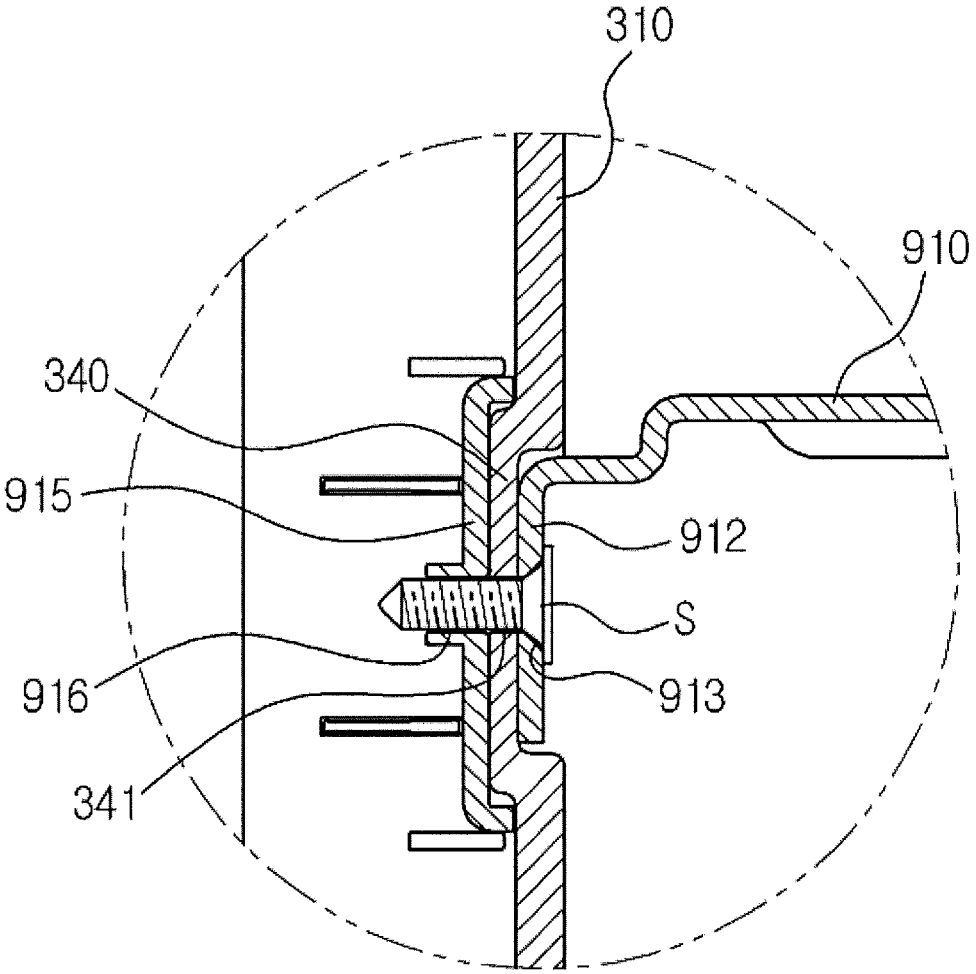
FIG. 15 is a cross sectional view illustrating a coupling structure of the first reinforcing member of the refrigerator of FIG. 1.

FIG. 13 is an exploded perspective view illustrating construction of the inner door of the refrigerator of FIG. 1 at a different angle, FIG. 14 is an exploded perspective view illustrating a coupling structure of a first reinforcing member of the refrigerator of FIG. 1, and FIG. 15 is a cross sectional view illustrating a coupling structure of the first reinforcing member of the refrigerator of FIG. 1.

Referring to FIGS. 13 and 15, the first reinforcing member 910 is fastened to the inside wall 310 of the inner panel 300 through a fastening member S. The fastening member may be a screw. A depression part 340 may be formed in the inside wall 310 such that the first reinforcing member 910 is coupled to the depression part 340.

The first reinforcing member 910 includes a connection part 911 traversing the opening 210, and a coupling part 912 bent from both ends of the connection part 911 and coming into close contact with the depression part 340.

The coupling part 912 has a fastening hole 913 allowing the fastening member S to pass therethrough, and the depression part 340 of the inside wall 310 has a fastening hole 341 allowing the fastening member S to pass therethrough.

In addition, an attachment panel 915 having a fastening hole 916 may be coupled at an opposite side of the first reinforcing member 910 with respect to the inside wall 310 to increase the fastening strength of the fastening member S. Accordingly, the fastening member S may sequentially pass through the first reinforcing member 910, the inside wall 310 and the attachment panel 915.

As described above, the first reinforcing member 910 directly connects the left side frame 303 and the right side frame 304 of the inner panel 300 to each other, which have relatively large lengths, by traversing the opening 210 so as to prevent the inner door 200 from being distorted. The second reinforcing member 920 is provided at the upper side frame 301 of the inner panel 300, the lower side frame 302 of the inner panel 300, the left side frame 303 of the inner panel 300 and the right side frame 304 of the inner panel 300 to reinforce four sides of the inner panel 300, thereby preventing the door 200 from being distorted.

In accordance with the embodiment of the present disclosure, both of the first reinforcing member 910 and the second reinforcing member 920 are provided, but one of the first reinforcing member 910 and the second reinforcing member 920 may be provided as needed.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body;

a storage compartment formed at an inside of the body;

an inner door comprising an opening corresponding to the storage compartment, an inner panel having an upper side frame, a lower side frame, a left side frame and a right side frame, and an outer panel coupled to the inner panel, the inner door rotatably coupled to the body;

a plurality of door guards provided at the opening;

an outer door rotatably coupled to the body to open and close the opening;

at least one first reinforcing member configured to connect the left side frame to the right side frame while traversing the opening; and a second reinforcing member provided at the upper side frame, the lower side frame, the left side frame and the right side frame.

2. The refrigerator of claim 1, wherein the inner panel comprises one pair of inside walls that support the plurality of door guards while forming the opening, and the at least one first reinforcing member is fastened to the pair of inside walls through a fastening member.

3. The refrigerator of claim 2, wherein the pair of inside walls are formed to be flat from an entry of the opening to an exit of the opening, and a distance between the one pair of inside walls from the entry of the opening to the exit of the opening is constant.

4. The refrigerator of claim 2, wherein the at least one first reinforcing member comprises a connection part traversing the opening, and one pair of coupling parts coming into close contact with the one pair of inside walls by being bent from both ends of the connection part.

5. The refrigerator of claim 2, further comprising an attachment panel that is provided at an opposite side of the at least one first reinforcing member with respect to the pair of inside walls to increase a fastening force of the fastening member such that the attachment panel is fastened to the at least one first reinforcing member and the pair of inside walls.

6. The refrigerator of claim 2, wherein the fastening member is a screw.

7. The refrigerator of claim 1, wherein the second reinforcing member is provided at an inner space formed by the inner panel and the outer panel.

8. The refrigerator of claim 1, wherein the inner panel is provided with an accommodation space to accommodate the second reinforcing member and with a hook part to fix the second reinforcing member.

9. The refrigerator of claim 8, wherein the second reinforcing member is fixed to the inner panel before blowing agent is foamed between the inner panel and the outer panel.

10. The refrigerator of claim 1, wherein the second reinforcing member is integrally formed of an upper side reinforcing part, a lower side reinforcing part, a left side reinforcing part and a right side reinforcing part in a shape of a rectangular frame.

11. A refrigerator comprising:

a body;

a storage compartment formed at an inside of the body;

an inner door comprising an opening corresponding to the storage compartment, an inner panel having an upper side frame, a lower side frame, a left side frame and a right side frame, and an outer panel coupled to the inner panel, the inner door rotatably coupled to the body;

a plurality of door guards provided at the opening;

an outer door rotatably coupled to the body to open and close the opening;

at least one reinforcing member configured to connect the left side frame to the right side frame while traversing the opening to prevent the inner door from being distorted;

a fastening member configured to fasten the at least one reinforcing member to the left side frame and the right side frame; and attachment panels that are provided at the left side frame and the right side frame to increase a fastening force of the fastening member.

12. A refrigerator comprising:

a body;

a storage compartment formed at an inside of the body;

an inner door comprising an opening corresponding to the storage compartment, an inner panel having an upper side frame, a lower side frame, a left side frame and a right side frame, and an outer panel coupled to the inner panel, the inner door rotatably coupled to the body;

a plurality of door guards provided at the opening;

an outer door rotatably coupled to the body to open and close the opening; and a reinforcing member provided at the upper side frame, the lower side frame, the left side frame and the right side frame to prevent the inner door from being distorted.

13. The refrigerator of claim 12, wherein the reinforcing member is integrally formed of an upper side reinforcing part, a lower side reinforcing part, a left side reinforcing part and a right side reinforcing part.

14. The refrigerator of claim 13, wherein the inner panel is provided with an accommodation space to accommodate the reinforcing member and with a hook part to fix the reinforcing member.

15. The refrigerator of claim 12, further comprising a plurality of installation members, the plurality of installation members including a first installation member coupled to the upper side frame, a second installation member coupled to the lower side frame, a third installation member coupled to the left side frame, and a fourth installation member coupled to the right side frame, wherein each of the plurality of installation members include an installation groove configured to receive a gasket and an installation protrusion protruding inward of the installation groove to fix the gasket.

16. The refrigerator of claim 15, wherein the first installation member, the second installation member, the third installation member and the fourth installation member are not connected to one other and are spaced apart from one another by a predetermined gap.

17. The refrigerator of claim 15, wherein the inner panel is provided at a rim of a rear surface thereof with an accommodation groove to accommodate the plurality of installation members.

18. The refrigerator of claim 17, wherein the accommodation groove has a cross sectional area increasing from a deepest position thereof to a shallowest position thereof.

* * * * *